US006189247B1

(12) United States Patent
Gebka

(10) Patent No.: US 6,189,247 B1
(45) Date of Patent: Feb. 20, 2001

(54) ADJUSTABLE LENGTH, ELONGATED HOOK LABEL HOLDER

(75) Inventor: John Gebka, Coral Springs, FL (US)

(73) Assignee: Fast Industries, Ltd., Fort Lauderdale, FL (US)

( * ) Notice: Under 35 U.S.C. 154(b), the term of this patent shall be extended for 0 days.

(21) Appl. No.: 09/046,509

(22) Filed: Mar. 24, 1998

(51) Int. Cl.[7] ..... G09F 3/00
(52) U.S. Cl. ..... 40/642.01; 40/657; 40/642.02
(58) Field of Search ..... 40/642.01, 642.02, 40/661.03, 651, 657

(56) References Cited

U.S. PATENT DOCUMENTS

| | | | | |
|---|---|---|---|---|
| 4,463,510 | | 8/1984 | Windish . | |
| 4,525,944 | | 7/1985 | Fast . | |
| 4,583,306 | * | 4/1986 | Taub | 40/642.01 |
| 4,646,454 | | 3/1987 | Fast . | |
| 4,665,639 | | 5/1987 | Fast . | |
| 4,693,024 | | 9/1987 | Fast . | |
| 4,694,595 | | 9/1987 | Fast . | |
| 4,698,929 | | 10/1987 | Fast . | |
| 4,703,570 | | 11/1987 | Fast . | |
| 4,715,135 | | 12/1987 | Fast . | |
| 4,754,563 | | 7/1988 | Fast . | |
| 4,888,897 | * | 12/1989 | Fast | 40/657 |
| 4,934,080 | | 6/1990 | Fast . | |
| 5,040,316 | * | 8/1991 | Fast | 40/642.01 X |
| 5,123,189 | * | 6/1992 | Fast et al. | 40/642.01 |
| 5,261,175 | | 11/1993 | Gebka . | |

* cited by examiner

*Primary Examiner*—Lynne H. Browne
*Assistant Examiner*—James M. Hewitt
(74) *Attorney, Agent, or Firm*—Jacobson, Price, Holman & Stern, PLLC

(57) ABSTRACT

A product identification and information tag of sheet material for overlying an elongated support hook, wherein the mounting portion of the tag is frictionally engaged over projections on a saddle member carried by the hook itself. The length of the tag can be readily adjusted without the need for extraneous tools such as scissors or the like. The mounting portion of the tag is provided with a series of longitudinally spaced mounting apertures with alternating fold and tear lines spaced midway between adjacent apertures whereby the mounting portion may be folded onto itself to align adjacent apertures, transversely tom, or even transversely tom and then folded on itself to provide the tag with different effective lengths.

10 Claims, 4 Drawing Sheets

ADJUSTABLE LENGTH, ELONGATED HOOK LABEL HOLDER

This invention relates to product identification and information tags for merchandise suspended from horizontally extending product support hooks and relates, more particularly to elongated tags having a label holder at their distal end and a mounting portion at their proximal end adapted for use with a saddle member carried by the hook, wherein the mounting portion is designed to permit the user to readily adjust the length of the tag without the need for scissors or other extraneous cutting means.

BACKGROUND OF THE INVENTION

Forwardly extending product information tags adapted to overlie elongated product support hooks to provide a display portion or label holder forwardly of the distal end of the hook are now well known. Such hooks commonly have a proximal end adapted to be attached to a support surface such as an apertured board, a wire grid or the like, an elongated intermediate portion projecting substantially horizontally from the support surface for carrying product, and a free distal end. There are many different forms of such hooks, several styles being illustratively shown, for example, in Fast U.S. Pat. No. 4,525,944, issued Jul. 2, 1985 (the Fast '944 patent), Fast U.S. Pat. No. 4,703,570, issued Nov. 3, 1987 (the Fast '570 patent), Fast U.S. Pat. No. 4,715,135, issued Dec. 29, 1987 (the Fast '135 patent) and Fast U.S. Pat. No. 4,754,563, issued July 1988 (the Fast '563 patent), the subject matter of each of which is incorporated herein in its entirety by reference. Commonly, such hooks have a single elongated merchandise support rod, the distal end of which may be passed through apertures formed in the cards of blister-packed or other such products. Alternatively, the hook can be formed of a pair of laterally spaced rods or a double rod formed by a U-shaped loop of plastic or metal. The two rods of a double rod may be used to individually support apertured products or, like a double looped hook, can receive products with elongated slots defined therein.

Depending on the type of support, the proximal end of such hooks may take various forms. For example, the mounting means may include a pair of spaced, horizontally extending arms which project through two openings in an apertured board, and are bent upwardly behind the board so as to retain the bracket and support hook in place. With a single rod, the mounting arms may be carried by a cross bar or be formed as part of a mounting plate to which the proximal end of the support hook is secured. In the case of the double looped hook, the proximal ends of the rods may include generally upwardly extending arms or sections adapted to be engaged in juxtaposed openings of an apertured board or the like.

In the prior art, various forms of mounting means are provided on the proximal end of forwardly extending product identification tags adapted for use with such elongated hooks. For example, in Windish U.S. Pat. No. 4,463,510, issued Aug. 7, 1984 (the Windish patent), the subject matter of which is also incorporated herein by reference, a plurality of longitudinally spaced pairs of apertures are provided, one pair of apertures being adapted to receive the arms of the mounting portion of a hook, with other pairs of apertures forming weakened portions enabling the tag to be bent for selectively adjusting the length of the tag to accommodate hooks of various sizes. The Fast '944 patent illustrates a mounting portion on the tag comprising multiple apertured or slotted panels foldable in different ways to receive the arms of the mounting portions of either a single or double loop-style hook.

While elongated hooks of the type described are commonly carried by apertured boards, oftentimes such hooks are adapted to be affixed to a different type of supporting surface such as elongated rods, grids, angle irons, plates or racks. Over the years, various adaptations of forwardly extending product information tags have been developed for use with such different forms of elongated hooks. Exemplary of such products, are those shown in Fast U.S. Pat. No. 4,646,454, issued Mar. 3, 1987 (the Fast '454 patent), Fast U.S. Pat. No. 4,665,639, issued May 19, 1987 (the Fast '639 patent), Fast U.S. Pat. No. 4,693,024, issued Sep. 15, 1987 (the Fast '024 patent), Fast U.S. Pat. No. 4,694,595, issued Sep. 22, 1987 (the Fast '595 patent), Fast U.S. Pat. No. 4,698,929, issued Oct. 13, 1987 (the Fast '929 patent), and Gebka U.S. Pat. No. 5,261,175, issued Nov. 16, 1993 (the Gebka patent), the subject matter of all of the aforementioned patents being incorporated herein in their entireties by reference thereto.

For the most part, forwardly extending product information display tags of the type described have been adapted to be supported in one form or another at their proximal end at the point where the proximal end of the hook is secured to a support surface. However, considering the variety of hook and support surface constructions, this generally required different tags to be designed for each application.

The one thing common to substantially all such hook arrangements is at least one forwardly extending elongated rod adapted to carry products. In Karnes et al, U.S. Pat. No. 4,934,080, issued Jun. 19, 1990 (the Karnes et al patent), support for the proximal end of the forwardly extending elongated tag is provided by a separate element in the form of a saddle member slidably and removably mounted on the elongate intermediate rod-like portion of the hook, generally adjacent the proximal end of the hook. The Karnes et al saddle can have a single clasp or other such element for mounting the same on a hook with a single rod, or a pair of spaced clasps or the like for mounting the same on a double-loop hook.

The saddle member defines a generally horizontally extending support surface with upstanding projections adapted to be frictionally engaged in complementary apertures defined in the mounting portion of the tag. The use of such a saddle member enables the elongated forwardly extending product information tag to be readily secured to a hook, without removing the hook from its engagement with an apertured board or other such support member. Moreover, with the saddle member carried by the forwardly extending rod-like portion of the hook, the mounting portion of the tag is not dependent upon the manner in which the support hook is engaged with an apertured board or other such support member. Thus, the design of the tag can be more universal.

Heretofore, forwardly extending product information tags adapted for use with a saddle member such as shown in the Karnes et al patent have been marketed with a plurality of longitudinally spaced pairs of apertures complementary to the saddle member support projections whereby the tag can be shortened to adapt the same to hooks of different lengths by cutting off unwanted portions of the proximal end of the tag at a point between a selected pair of mounting apertures. Such a design requires the use of a pair of scissors or other such cutting means, oftentimes not readily available. In addition to the need for an extraneous tool to adjust the length of an elongated tag of this nature, the cutting operation is time consuming, and if the cut is not true, the tag may not fit properly and can be unsightly.

SUMMARY OF THE INVENTION

Accordingly, it is a primary object of this invention to provide an elongated, forwardly extending product information tag of the type adapted for use with a Karnes et al-type saddle member which can be quickly and easily adjusted to a desired length without the need for extraneous tools, such as scissors or the like.

Yet another object of this invention is the provision of a die-cut, forwardly extending, product information tag, the proximal end of which is adapted for support by a saddle member carried on the intermediate rod-like portion of an underlying hook, with appropriate fold lines and tear lines provided in the mounting portion of the tag to enable the same to be selectively folded and/or tom for varying the length of the tag in use to accommodate hooks of different sizes.

A further object of this invention is the provision of a product information tag designed to enable the user to either fold or tear off undesired portions of the proximal end of the tag to select one of at least four different lengths, whether the hook is of the single or double loop configuration, and regardless of the manner in which the hook is secured to an apertured board or other such support.

A still further object of this invention is the provision of an adjustable length tag or label holder adapted to overlie an elongated hook, wherein the tag may be die-cut in one of a variety of configurations from a sheet of plastic material of any appropriate polymer, in a high speed manufacturing process.

Another important object of this invention is the provision of an adjustable length, forwardly extending, product information label holder having a tear line defined therein by transversely extending cuts, with proximal end portions of the tag underlying the tear line in certain applications to provide additional support thereto in use.

BRIEF DESCRIPTION OF THE DRAWINGS

These and other objects, features and many of the attendant advantages of the invention will be better understood upon consideration of the following detailed description of the preferred embodiments, taken in conjunction with the accompanying drawings wherein.

DESCRIPTION OF THE PREFERRED EMBODIMENTS

Figures 1, 2, 3:
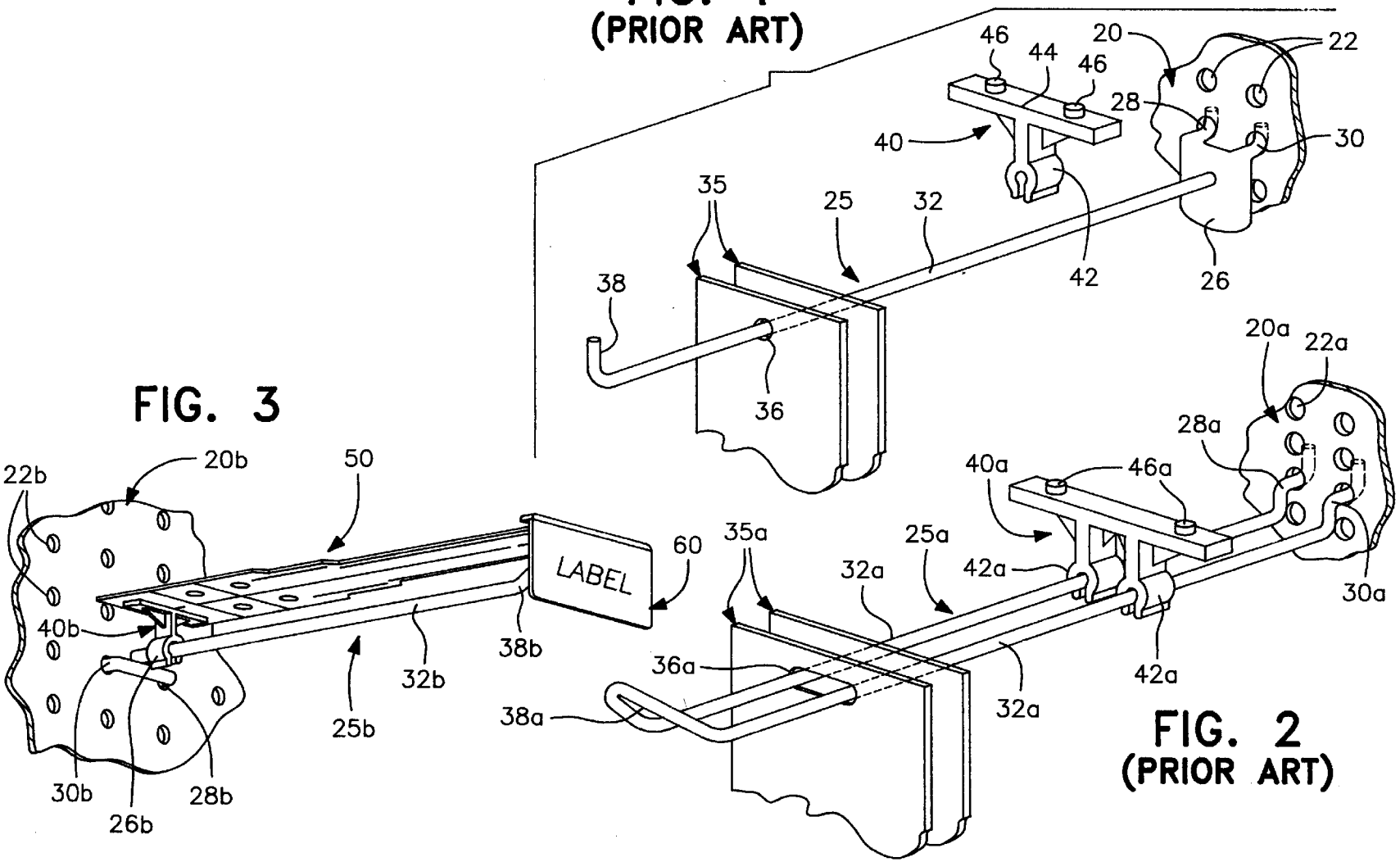
FIG. 1 (PRIOR ART)
FIG. 2 (PRIOR ART)
FIG. 1 is an exploded fragmentary perspective view of one embodiment of a prior art horizontally extending hook with a plate-type backing having offset legs engaged in a conventional apertured board, with a saddle member of the type described above positioned for mounting on the hook.
FIG. 2 is a similar view of a double loop-type prior art horizontally extending hook with a modified saddle member secured thereto.
FIG. 3 is a perspective view of a third type of horizontally extending hook engaged in an apertured board with a saddle member carried by the proximal end thereof, and an adjustable length, elongated, longitudinally extending label holder according to the instant invention secured thereto.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Reference is now made to the drawings wherein like parts are identified by the same reference characters. An apertured board 20 of the type which is conventionally employed in conjunction with merchandise displays in retail establishments includes a multiplicity of through-apertures 22 at generally regularly spaced intervals to receive suitable merchandise support members. In the embodiment illustrated in FIG. 1, one form of support hook 25 is shown as having a plate 26 at its proximal end with a pair of laterally spaced, horizontally extending arms 28, 30 which project through two of the apertures 22 and are bent upwardly behind the board 20 so as to retain the plate 26, and the intermediate portion 32 of the hook 25, which is in the nature of an elongated, rod-like support member fixed to the plate 26, in place. The support member 32, when thus retained in place, projects forwardly from the apertured board 20 in a generally horizontal orientation, so that merchandise, such as the blister packs illustratively shown at 35 with suitable support apertures 36 defined therein, may be suspended therefrom. The distal end 38 of the support hook 25 may be bent upwardly to facilitate retention of the products 35 on the hook.

A saddle member such as disclosed in the Karnes et al patent is illustratively shown at 40 as comprising a downwardly depending claw member 42 which can be snapped over, and slid longitudinally of, the intermediate portion 32 of the hook 25. The claw member 42 supports a transverse, generally horizontally-extending platform 44 with a pair of laterally spaced, upstanding projections 46 adapted to frictionally engage complementary apertures of a forwardly extending display tag (not shown in FIG. 1).

In FIG. 2, wherein parts similar to those of FIG. 1 are designated by the same reference number followed by the suffix "a", a loop-type hook 25*a* is illustrated as comprising a pair of elongated horizontally-extending intermediate portions 32*a* interconnected at their distal end by an upwardly bent bight 38*a* so as to receive blister carded or other products 35*a* having elongated apertures or slots 36*a*. The saddle member 40*a* in FIG. 2 comprises a pair of downwardly depending claws 42*a* frictionally engaged over respective rods 32*a* to support the platform 44*a* with the upstanding projections 46*a*.

In FIG. 3, wherein like parts are designated by the same reference number followed by the suffix "b", yet another modified form of an elongated hook 25*b* is illustrated, including, at the proximal end, a transversely-extending rod 26*b* having spaced horizontally extending arms 28*b*, 30*b* bent upwardly behind board 20*b* (not shown) so as to retain the support member 32*b* in position, projecting forwardly from the apertured board 20*b* in a generally horizontal orientation.

Figure 4:
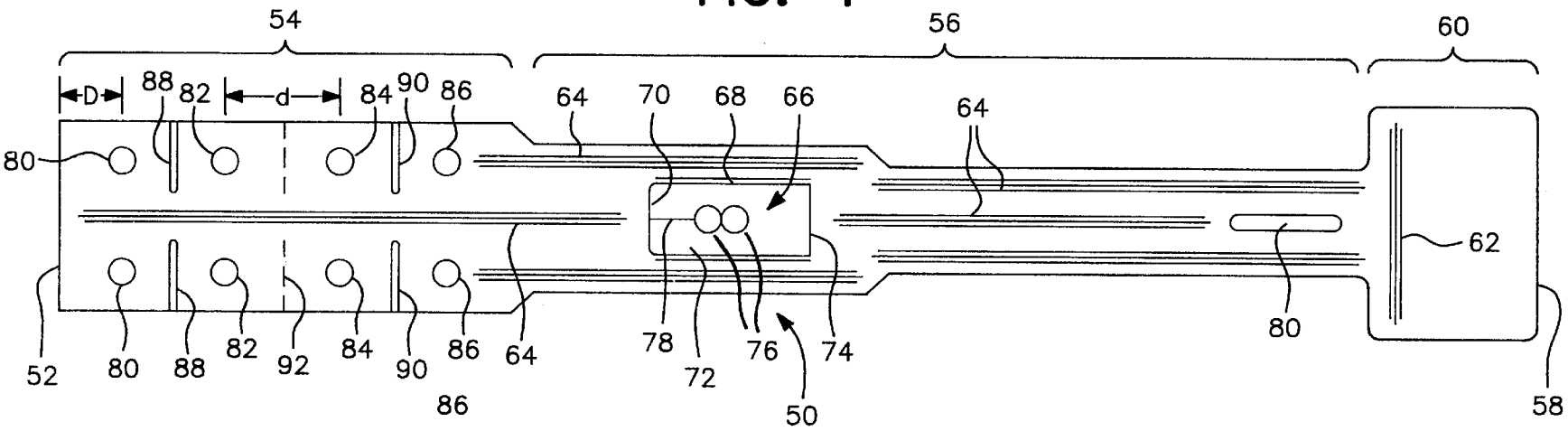
FIG. 4 is a plan view of a preferred form of longitudinally extending, adjustable length, tag or label holder according to this invention.

A saddle member 40*b*, substantially identical to the saddle member 40 shown in FIG. 1, is mounted on the member 32*b* to support an adjustable length, forwardly-extending, product information tag or label holder according to this invention, designated generally by the reference numeral 50 and shown in detail in FIG. 4. Referring to FIG. 4, the product identification and information tag 50 is formed of a sheet of any selected plastic material, preferably die cut to the configuration shown. The tag 50 comprises a proximal end 52, a mounting portion 54 adjacent the proximal end for releasably attaching the tag 50 to a hook via a saddle member as will be discussed in more detail below, an elongate intermediate portion 56 extending from the mounting portion 54 for overlying the intermediate portion of the hook, a distal end 58 and a display portion 60 adjacent the distal end 58 for carrying product identification and/or information, including pricing and barcode indicia, or the like.

The display portion may take any conventional form, and can be integral with the tag 50 as shown in FIG. 4 with a transverse fold line 62 in the form of a crease or the like, impressed in the plastic sheet to enable the display portion to be bent so as to depend from the intermediate portion of the tag forwardly of the distal end of the hook as shown, for example, in FIG. 3.

If desired, a transverse slit may be formed at the distal end of the intermediate portion (not shown) for the releasable receipt of a separate display element adapted to carry product labeling or the like, as shown, for example, in several of the Fast patents identified above.

Similarly, if desired, the display portion may be provided with a reverted pocket-forming element as shown, for example, in the Fast '570, for receipt of a paper label.

The particular form and construction of the display portion of the tag is not a principal portion of the instant invention.

Likewise, the intermediate portion 56 of the tag 50 may take any conventional form, including, for example, longitudinally-extending creases or ribs as shown at 64 to rigidify or strengthen the same in the manner discussed in the detail in the Fast '135 patent.

Additionally, if desired, one or more fold-down stabilizing and/or product inventory tabs such as shown at 66 may be provided in the intermediate portion 56 of the tag, cut through on three sides, 68, 70, 72 and otherwise secured to the material of the intermediate portion 56 of the tag by a fold line 74, with one or more bar-receiving apertures 76 engageable over the intermediate portion of the hook via a cut line 78 in the manner discussed, for example, in the aforementioned Gebka patent.

A longitudinal slot 80 may also be provided near the forward end of the intermediate portion 56 for the upwardly bent distal end portion of a product suspension hook to project through or engage in. In general, the forward end of the intermediate portion of the tag rests on, or is otherwise supported by, the distal end of the hook.

As with the display portion 60 of the tag 50, the details of the intermediate portion 56 are not a principal feature of the instant inventive concepts.

This invention is primarily concerned with the mounting portion 54 of the tag 50 which is adapted for use with a saddle member such as shown in FIGS. 1 and 2 and discussed in detail in the Karnes et al patent. To that end, the mounting portion 54 has at least four sets of longitudinally spaced mounting apertures, 80, 82, 84 and 86, the mounting apertures being provided in laterally spaced pairs in the embodiment shown in FIG. 4 for use with a saddle having a pair of laterally spaced upstanding projections 46 as shown in FIGS. 1 and 2. The pairs of mounting apertures are each adapted to be frictionally engaged over the complementary upstanding support projections on a saddle member carried by underlying hook in the manner shown, for example, in FIG. 3.

According to the preferred embodiment of the instant invention, the pairs of mounting apertures 80, 82, 84, 86 are spaced equally from each other longitudinally of the mounting portion 54 by a distance "d". A first transverse fold line 88 is defined in the mounting portion 54 midway between the first and second pairs of apertures, 80, 82, respectively. A second transverse fold line 90 is defined in the mounting portion 54 midway between the third and fourth pairs of apertures 84, 86, respectively. A tear line 92 is defined in the mounting portion 54 midway between the second and third pairs of apertures, 82, 84, respectively.

The first and second fold lines, 88, 90 are preferably defined by transverse creases impressed into the plastic sheet material during the die cutting of the tag 50, and the tear line 92 is preferably defined by transverse cuts formed in the mounting portion in the same operation.

Figure 5:
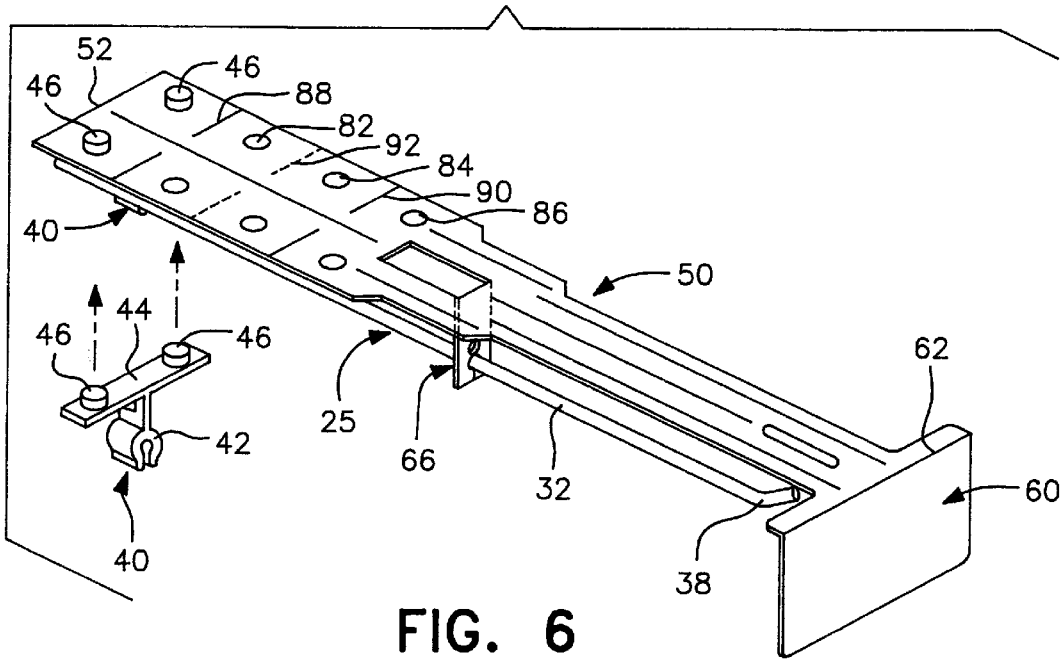
FIG. 5 schematically illustrates the manner in which the full length of the label holder of the instant invention is associated with a saddle member in accordance with the instant inventive concepts.

Referring now to FIGS. 5–11, it will be seen how the design of the mounting portion of the tag of the instant invention enables the user to selectively adjust the length of the tag 50 without the need for extraneous tools, such as scissors or the like. If it desired to use the full length of the tag 50, the first pair of mounting apertures 80 are frictionally engaged over the saddle member projections 46 as shown in FIG. 5.

In this Figure, the tab 66 is shown as folded down so that the bar-receiving cut-out 76 is engaged over the intermediate portion 32 of the hook 25. This assists in stabilizing the tag 50 and may also function to retain product (not shown) on the hook 25 toward the forward end thereof for ease of access by customers, if desired.

Figure 6:
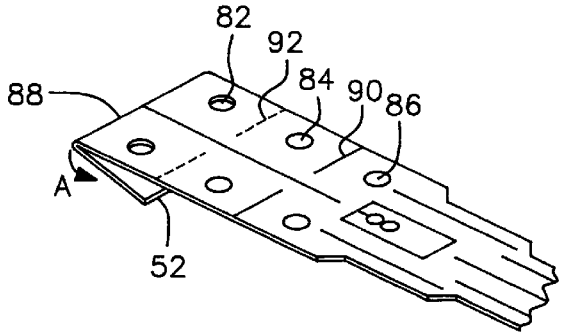
FIG. 6 is fragmentary perspective view showing the mounting portion of an elongated tag according to this invention folded to effectively reduce the length of the tag by the approximate distance between each of the pairs of longitudinally spaced support apertures defined in the proximal end portion thereof.
Figure 7:
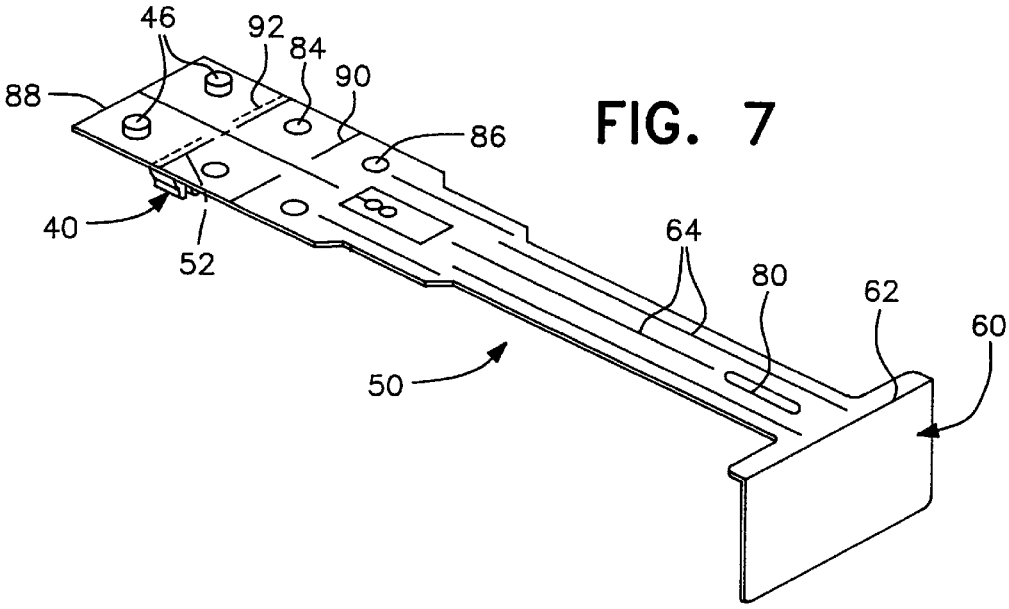
FIG. 7 shows a tag folded in the manner of FIG. 6 supported on a saddle member.

The length of the tag 50 can be reduced by the distance "d" between mounting apertures by folding the mounting portion 54 of the tag along the first fold line 88 in the direction of the arrow "A" shown in FIG. 6 thereby aligning the first and second pairs of mounting apertures 80, 82, whereby the aligned first and second pairs of mounting apertures 80, 82 can be frictionally engaged over the saddle member projections 46 as seen in FIG. 7.

According to a preferred feature of the instant inventive concepts, the first pair of mounting apertures 80 is spaced from the proximal end 52 of the tag 50 by a distance "D" which is slightly greater than one-half of the distance "d" between the pairs of mounting apertures. In this manner, when the length of the tag is reduced by the distance "d" between the mounting apertures by folding the mounting portion 54 of the tag 50 along the first fold line 88 to align the first and second pairs of mounting apertures 80, 82, a proximal end portion of the tag 50 underlies the tear line 92 to increase the support for the tag 50 at the tear line 92 as shown in FIGS. 6 and 7.

Figure 8:
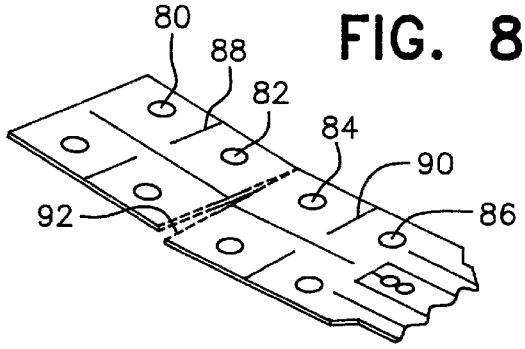
FIG. 8 schematically illustrates the manner in which the mounting portion of the tag member can be shortened by twice the longitudinal spacing between the mounting apertures by tearing the same along a prescored tear line between the second and third pair of apertures.
Figure 9:
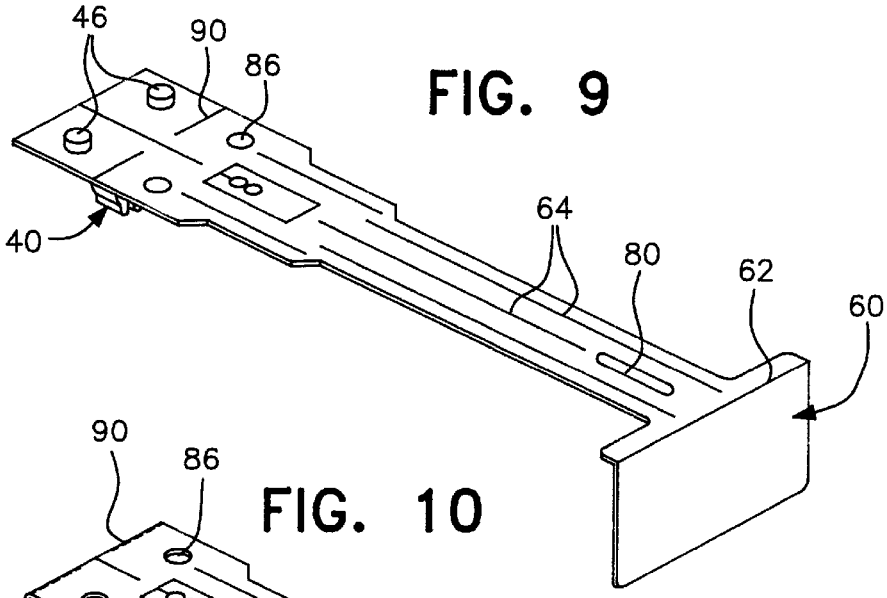
FIG. 9 shows a tag shortened as shown in FIG. 8 supported on a saddle member.

When it is desired to reduce the length of the tag by twice the distance "d" between mounting apertures, the mounting portion may be transversely torn along the tear line 92 in the manner shown in FIG. 8, and the third pair of mounting apertures 84 may then be frictionally engaged over the saddle member projections 46 as shown in FIG. 9.

Figure 10:
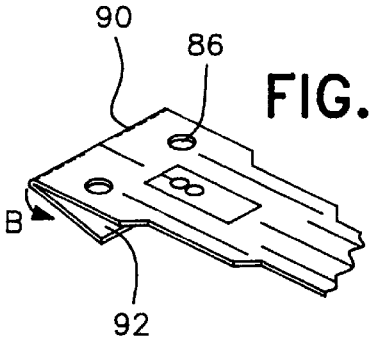
FIG. 10 is a fragmentary perspective view schematically illustrating the mounting portion of an elongated tag according to this invention shortened by triple the distance between the longitudinally spaced pairs of mounting apertures.
Figure 11:
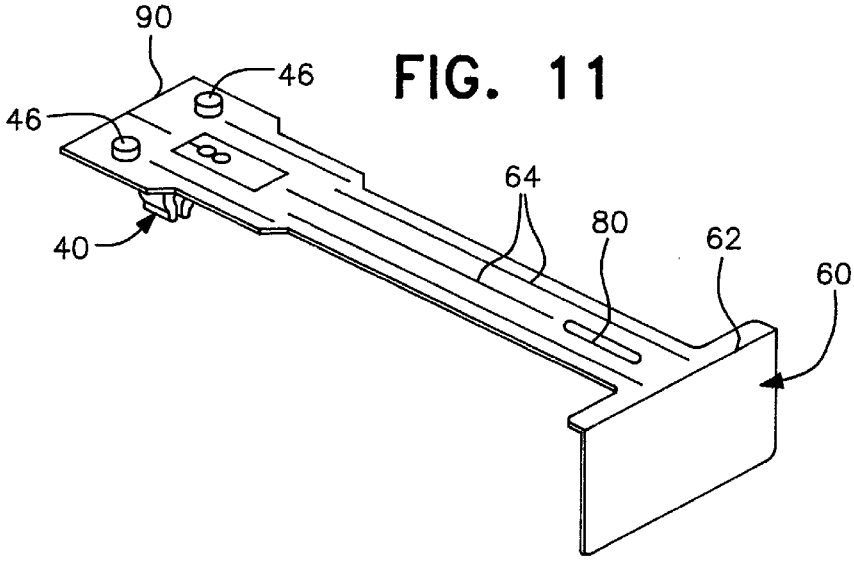
FIG. 11 shows a fully shortened tag supported on a saddle member.

Finally, when the length of the tag is to be reduced by three times the distance "d" between the mounting apertures, the mounting portion 54 of the tag 50 is first transversely tom along the tear line 92 as shown in FIG. 8, and then folded along the second fold line 90 in the direction of the arrow "B" in FIG. 10 to align the third and fourth pairs of mounting apertures 84, 86 so that the aligned third and fourth pairs of mounting apertures 84, 86 may be frictionally engaged over the saddle member projections 46 as seen in FIG. 11.

Considering the foregoing, it will now be evident to those with ordinary skill in the art, that the product identification and information tag of the instant invention is designed to be readily adjusted without the need for scissors to any of four selected lengths by simply transversely folding and/or tearing the mounting portion of the tag in the manner discussed. This enables the forwardly extending label holder of the instant invention to be inexpensively manufactured, and efficiently and expeditiously adjusted to length by the user without the need for scissors or other cutting tools.

Although laterally spaced pairs of mounting apertures are shown for use with saddle members having laterally spaced upstanding mounting projections, it will be understood that the saddle member could include a single upstanding projection, or more than two projections, with the mounting portion of the tag of the instant invention being provided with longitudinally spaced complementary sets of mounting apertures. The size and shape of the mounting projections and the mounting apertures can be varied as desired. Moreover, while only four pairs of laterally spaced mounting apertures are shown in the illustrative embodiment, additional longitudinally spaced pairs of mounting apertures could be provided with alternating folds and tear lines if longer tags are of interest.

While only preferred embodiments of the instant invention have been illustrated and described herein in detail, it is to be understood that the invention is not limited thereby and numerous modifications can be made by those of ordinary skill in the art within the scope of the appended claims.

Having described the invention, many modifications thereto will become apparent to those skilled in the art to which it pertains without deviation from the spirit of the invention as defined by the scope of the appended claims.

I claim:

1. In a product identification and information tag of sheet material for use in conjunction with an elongate hook wherein:

the hook includes a proximal end to be attached to a support surface, an intermediate portion to project substantially horizontally from the support surface for suspending products thereon, and a free distal end for receipt of the products to be suspended on the hook, the tag includes a proximal end with a mounting portion, an elongate intermediate portion extending from the mounting portion for overlying the intermediate portion of the hook, and a distal end with a display portion for displaying product identification and/or information data adjacent the distal end of the hook, the distance between the proximal end and the distal end of the tag being the full length of the tag, and the mounting portion of the tag includes mounting apertures to be frictionally engaged over complementary upstanding support projections on a saddle member carried by the intermediate portion of the hook;

the improvement which comprises:

at least first, second, third and fourth mounting apertures defined in longitudinally spaced relationship to each other in the mounting portion of the tag, the first and second mounting apertures being spaced a first distance from each other longitudinally of the mounting portion, the second and third mounting apertures being spaced a second distance from each other longitudinally of the mounting portion, and the third and fourth mounting portions being spaced a third distance from each other longitudinally of the mounting portion, said first, second and third distances being substantially the same and being the distance between said mounting apertures, a first fold line defined in the mounting portion midway between the first and second mounting apertures, a second fold line defined in the mounting portion midway between the third and fourth mounting apertures, and a tear line defined in the mounting portion midway between the second and third mounting apertures, whereby:

a) the full length of the tag can be utilized by engaging the first mounting apertures over the saddle member projections;

b) the length of the tag can be reduced by the distance between mounting apertures by folding the mounting portion of the tag along the first fold line to align the first and second mounting apertures, and engaging the aligned first and second mounting apertures over the saddle member projections;

c) the length of the tag can be reduced by twice the distance between mounting apertures by tearing the mounting portion of the tag along the tear line, and engaging the third mounting apertures over the saddle member projections; and d) the length of the tag can be reduced by three times the distance between mounting apertures by tearing the mounting portion of the tag along the tear line, folding the mounting portion of the tag along the second fold line to align the third and fourth mounting apertures, and engaging the aligned third and fourth mounting apertures over the saddle member projections, wherein the first mounting apertures are spaced from the proximal end of the tag by a distance slightly greater than one-half the longitudinal distance between the mounting apertures, so that when the length of the tag is reduced by the distance between mounting apertures by folding the mounting portion of the tag along the first fold line to align the first and second mounting apertures, a proximal end portion of the tag underlies the tear line to increase the support for the tag tear line.

2. The tag of claim 1 wherein the saddle member includes a pair of laterally spaced upstanding support projections, and wherein said first, second, third and fourth mounting apertures in said tag comprise first, second, third and fourth pairs of longitudinally spaced complementary mounting apertures.

3. The tag of claim 1 wherein the first and second fold lines are defined by transverse creases in the mounting portion of the tag.

4. The tag of claim 1 wherein the tear line is defined by transverse cuts in the mounting portion of the tag.

5. The tag of claim 1, further including a third fold line between the intermediate and display portions of the tag, whereby the display portion of the tag can be folded about the third fold line to depend from the intermediate portion of the tag forwardly of the distal end of the hook.

6. In a combination of a product identification and information tag of sheet material and an elongate hook:

a support surface, the hook including a proximal end attached to a support surface, an intermediate portion projecting substantially horizontally from the support surface for suspending products thereon, and a free distal end for receipt of the products to be suspended on the hook, the tag including a proximal end with a mounting portion, an elongate intermediate portion extending from the mounting portion and overlying the intermediate portion of the hook, and a distal end with a display portion adjacent the distal end of the hook, the distance between the proximal end and the distal end of the tag being the full length of the tag, a saddle member carried by the intermediate portion of the hook, the saddle member including upstanding projections, and the mounting portion of the tag including complementary mounting apertures to be frictionally engaged over the saddle member projections, the improvement which comprises:

at least first, second, third and fourth mounting apertures defined in longitudinally spaced relationship to each other in the mounting portion of the tag, the first and second mounting apertures being spaced a distance from each other longitudinally of the mounting portion, the second and third mounting apertures being spaced a second distance from each other longitudinally of the mounting portion, and the third and fourth mounting portions being spaced a third distance from each other longitudinally of the mounting portion, said first, second and third distances being substantially the same and being the distance between said mounting apertures, a first fold line defined in the mounting portion midway between the first and second mounting apertures, a second fold line being in the mounting portion midway between the third and fourth mounting apertures, and a tear line defined in the mounting portion midway between the second and third mounting apertures, whereby:

a) the fill length of the tag can be utilized by engaging the first mounting aperture over the saddle member projections;

b) the length of the tag can be reduced by the distance between mounting apertures by folding the mounting portion of the tag along the first fold line to align the first and second mounting apertures, and engaging the aligned first and second mounting apertures over the saddle member projections;

c) the length the tag can be reduced by twice the distance between mounting apertures by tearing the mounting portion of the tag along the tear line, and engaging the third mounting apertures over the saddle member projections; and d) the length of the tag can be reduced by three times the distance between mounting apertures by tearing the mounting portion of the tag along the tear line, folding the mounting portion of the tag along the second fold line to align the third and fourth mounting apertures, and engaging the aligned third and fourth mounting apertures over the saddle member projections, wherein the first mounting apertures are spaced from the proximal end of the tag by a distance slightly greater than one-half the distance between said first and second mounting apertures, so that when the length of the tag is reduced by the distance between mounting apertures by folding the mounting portion of the tag along the first fold line to align the first and second mounting apertures, a proximal end portion of the tag underlies the tear line.

7. The combination of claim 6 wherein the saddle member includes a pair of laterally spaced upstanding support projections, and wherein said first, second, third and fourth mounting apertures in said tag comprise first, second, third and fourth pairs of longitudinally spaced complementary mounting apertures.

8. The combination of claim 6 wherein the first and second fold lines are defined by transverse creases in the mounting portion of the tag.

9. The combination of claim 6 wherein the tear line is defined by transverse cuts in the mounting portion of the tag.

10. The combination of claim 6, further including a third fold line between the intermediate and display portions of the tag, the display portion of the tag being folded about the third fold line to depend from the intermediate portion of the tag forwardly of the distal end of the hook.

* * * * *